US009332369B2

(12) United States Patent
Jenkner et al.

(10) Patent No.: US 9,332,369 B2
(45) Date of Patent: May 3, 2016

(54) SYSTEM AND METHOD FOR AUTOMATIC CALIBRATION OF A TRANSDUCER

(71) Applicant: Infineon Technologies AG, Neubiberg (DE)

(72) Inventors: Christian Jenkner, Klagenfurt (AT); Richard Gaggl, Poertschach am (AT)

(73) Assignee: Infineon Technologies AG, Neubiberg (DE)

( * ) Notice: Subject to any disclaimer, the term of this patent is extended or adjusted under 35 U.S.C. 154(b) by 233 days.

(21) Appl. No.: 14/060,403

(22) Filed: Oct. 22, 2013

(65) Prior Publication Data

US 2015/0110295 A1 Apr. 23, 2015

(51) Int. Cl.

| | |
|---|---|
| ***H04R 3/00*** | (2006.01) |
| ***H04R 29/00*** | (2006.01) |
| ***H04R 1/08*** | (2006.01) |
| *H04S 7/00* | (2006.01) |

(52) U.S. Cl.

CPC ..... *H04R 29/004* (2013.01); *H04R 1/08* (2013.01); *H04R 3/00* (2013.01); *H04R 2201/003* (2013.01); *H04S 7/301* (2013.01)

(58) Field of Classification Search

None

See application file for complete search history.

(56) References Cited

U.S. PATENT DOCUMENTS

| | | | |
|---|---|---|---|
| 5,399,989 | A | 3/1995 | Chern |
| 6,121,908 | A | 9/2000 | Sevastopoulos et al. |
| 6,975,193 | B2 | 12/2005 | Knieser et al. |
| 7,088,981 | B2 | 8/2006 | Chang |
| 7,286,811 | B2 | 10/2007 | Kral |
| 7,304,679 | B1 | 12/2007 | Johnson et al. |
| 7,386,074 | B1 | 6/2008 | Venkatesh et al. |
| 7,522,193 | B2 | 4/2009 | Itani et al. |
| 7,548,626 | B2 | 6/2009 | Stenberg et al. |
| 7,589,766 | B2 | 9/2009 | Itani et al. |
| 7,646,883 | B2 | 1/2010 | Kogure et al. |
| 7,663,432 | B2 | 2/2010 | Prandi et al. |
| 7,719,595 | B1 | 5/2010 | Johnson et al. |
| 7,734,272 | B2 | 6/2010 | Kral |
| 7,986,182 | B2 | 7/2011 | Prandi et al. |
| 8,004,350 | B2 | 8/2011 | Draxelmayr |
| 8,067,958 | B2 | 11/2011 | Draxelmayr |
| 8,200,179 | B1 | 6/2012 | Mosinskis et al. |
| 8,325,949 | B2 | 12/2012 | Qian et al. |

(Continued)

FOREIGN PATENT DOCUMENTS

| | | |
|---|---|---|
| DE | 202011106756 | 4/2012 |
| EP | 1906704 | 4/2008 |

(Continued)

OTHER PUBLICATIONS

Delbruek, T., et al., "Analog VLSI Adaptive, Logarithmic, Wide-Dynamic-Range Photoreceptor," May 1994, 4 pages.

(Continued)

*Primary Examiner* — Regina N. Holder

(74) *Attorney, Agent, or Firm* — Slater & Matsil, LLP

(57) ABSTRACT

In accordance with an embodiment, an interface circuit includes a variable voltage bias generator coupled to a transducer, and a measurement circuit coupled to an output of the transducer. The measurement circuit is configured to measure an output amplitude of the transducer. The interface circuit further includes a calibration controller coupled to the bias generator and the measurement circuit, and is configured to set a sensitivity of the transducer and interface circuit during an auto-calibration sequence.

27 Claims, 7 Drawing Sheets

(56) References Cited

U.S. PATENT DOCUMENTS

| | | | | |
|---|---|---|---|---|
| 8,374,363 | B2 | 2/2013 | Onishi | |
| 8,625,809 | B2 | 1/2014 | Josefsson et al. | |
| 8,675,895 | B2 | 3/2014 | Hovesten et al. | |
| 2002/0039463 | A1 | 4/2002 | Degertekin et al. | |
| 2003/0155966 | A1 | 8/2003 | Harrison | |
| 2005/0219953 | A1 | 10/2005 | Bayram et al. | |
| 2006/0083392 | A1 | 4/2006 | Akino | |
| 2008/0075306 | A1 | 3/2008 | Poulsen et al. | |
| 2009/0134501 | A1 | 5/2009 | Ganitzer et al. | |
| 2011/0056302 | A1 | 3/2011 | Lutz | |
| 2011/0142261 | A1 | 6/2011 | Josefsson | |
| 2011/0150243 | A1 | 6/2011 | Onishi | |
| 2011/0175243 | A1 | 7/2011 | Jo et al. | |
| 2012/0250881 | A1 | 10/2012 | Mulligan | |
| 2013/0015919 | A1 | 1/2013 | Kropfitsch et al. | |
| 2013/0051582 | A1 | 2/2013 | Kropfitsch et al. | |
| 2013/0129116 | A1 | 5/2013 | Kropfitsch et al. | |
| 2013/0136267 | A1 | 5/2013 | Hammerschmidt et al. | |
| 2013/0271307 | A1 | 10/2013 | Kropfitsch et al. | |
| 2014/0064523 | A1* | 3/2014 | Kropfitsch et al. | 381/174 |
| 2014/0140538 | A1* | 5/2014 | Kropfitsch et al. | 381/106 |

FOREIGN PATENT DOCUMENTS

| | | | |
|---|---|---|---|
| EP | 2223654 | A1 | 9/2010 |
| EP | 2653846 | A1 | 10/2013 |
| JP | 2008209182 | A | 9/2008 |
| KR | 20110009150 | A | 1/2011 |
| WO | 2009135815 | A1 | 11/2009 |

OTHER PUBLICATIONS

Feng, P., et al., "History of the High-Voltage Charge Pump," Book Excerpt, Nov. 2006, pp. 1-9, Chapter 1, Professional Engineering 6X9, Charge Pump Circuit Design.

Harrison, R. R., et al., "A Low-Power Low Noise CMOS Amplifier for Neural Recording Applications," IEEE Journal of Solid-State Circuits, Jun. 2003, pp. 958-965, vol. 38, No. 6.

Harrison, R.R., "Integrated Circuits for Neural Interfacing," Circuits for Emerging Technologies, Feb. 15, 2008, pp. 1-12.

Oralkan, O., et al., "Experimental Characterization of Collapse-Mode CMUT Operation," IEEE Transactions on Ultrasonics, Ferroelectrics, and Frequency Control, Aug. 2006, 1513-1523, vol. 53, No. 8.

Vittoz, E., et al., "CMOS analog Integrated Circuits Based on Weak Inversion Operation," IEEE Journal of SolidState Circuits, Jun. 1977, pp. 224-231.

* cited by examiner

SYSTEM AND METHOD FOR AUTOMATIC CALIBRATION OF A TRANSDUCER

TECHNICAL FIELD

The present invention relates generally to transducers and circuits, and, in particular embodiments, to a system and method for automatic calibration of a transducer.

BACKGROUND

Transducers convert signals from one domain to another and are often used in sensors. A common sensor with a transducer that is seen in everyday life is a microphone, a sensor that converts sound waves to electrical signals.

Microelectromechanical system (MEMS) based sensors include a family of transducers produced using micromachining techniques. MEMS, such as a MEMS microphone, gather information from the environment through measuring physical phenomena, and electronics attached to the MEMS then process the signal information derived from the sensors. MEMS devices may be manufactured using micromachining fabrication techniques similar to those used for integrated circuits.

Audio microphones are commonly used in a variety of consumer applications such as cellular telephones, digital audio recorders, personal computers and teleconferencing systems. In a MEMS microphone, a pressure sensitive diaphragm is disposed directly onto an integrated circuit. As such, the microphone is contained on a single integrated circuit rather than being fabricated from individual discrete parts. The monolithic nature of the MEMS microphone produces a higher yielding, lower cost microphone.

MEMS devices may be formed as oscillators, resonators, accelerometers, gyroscopes, pressure sensors, microphones, micro-mirrors, and other devices, and often use capacitive sensing techniques for measuring the physical phenomenon being measured. In such applications, the capacitance change of the capacitive sensor is converted into a usable voltage using interface circuits. However, the fabrication of MEMS devices introduces variations in the physical size and shape, thereby causing variations in the characteristic performance of completed MEMS devices. For example, MEMS microphones fabricated in the same process with the same design may have some variation in sensitivity.

SUMMARY OF THE INVENTION

In accordance with an embodiment, an interface circuit includes a variable voltage bias generator coupled to a transducer, and a measurement circuit coupled to an output of the transducer. The measurement circuit is configured to measure an output amplitude of the transducer. The interface circuit further includes a calibration controller coupled to the bias generator and the measurement circuit, and is configured to set a sensitivity of the transducer and interface circuit during an auto-calibration sequence.

BRIEF DESCRIPTION OF THE DRAWINGS

For a more complete understanding of the present invention, and the advantages thereof, reference is now made to the following descriptions taken in conjunction with the accompanying drawing, in which.

Corresponding numerals and symbols in the different figures generally refer to corresponding parts unless otherwise indicated. The figures are drawn to clearly illustrate the relevant aspects of the embodiments and are not necessarily drawn to scale.

DETAILED DESCRIPTION OF ILLUSTRATIVE EMBODIMENTS

The making and using of various embodiments are discussed in detail below. It should be appreciated, however, that the various embodiments described herein are applicable in a wide variety of specific contexts. The specific embodiments discussed are merely illustrative of specific ways to make and use various embodiments, and should not be construed in a limited scope.

Description is made with respect to various embodiments in a specific context, namely microphone transducers, and more particularly, MEMS microphones. Some of the various embodiments described herein include MEMS transducer systems, MEMS microphone systems, interface circuits for transducer and MEMS transducer systems, and automatic methods of calibrating MEMS transducer systems. In other embodiments, aspects may also be applied to other applications involving any type of sensor or transducer converting a physical signal to another domain and calibrating such a sensor or transducer and interface electronics according to any fashion as known in the art.

Fabricated MEMS devices exhibit variation in performance characteristics. For example, MEMS microphones exhibit different sensitivity values even among MEMS microphones fabricated on a same wafer. According to various embodiments described herein, an interface circuit is presented capable of performing an auto-calibration procedure that determines bias voltages and amplifier gains in order to set overall transducer system sensitivity values within a target range for MEMS devices.

According to various embodiments, the auto-calibration procedure includes applying an audio signal of known amplitude to the system and applying an auto calibration start condition. During the auto calibration procedure, a bias voltage applied to the MEMS and/or a gain of a variable gain amplifier is adjusted until the overall sensitivity of the system approaches a target sensitivity. In some embodiments, this auto-calibration procedure, once started, occurs on-chip (e.g. within the interface circuit and the MEMS microphone).

Figure 1:
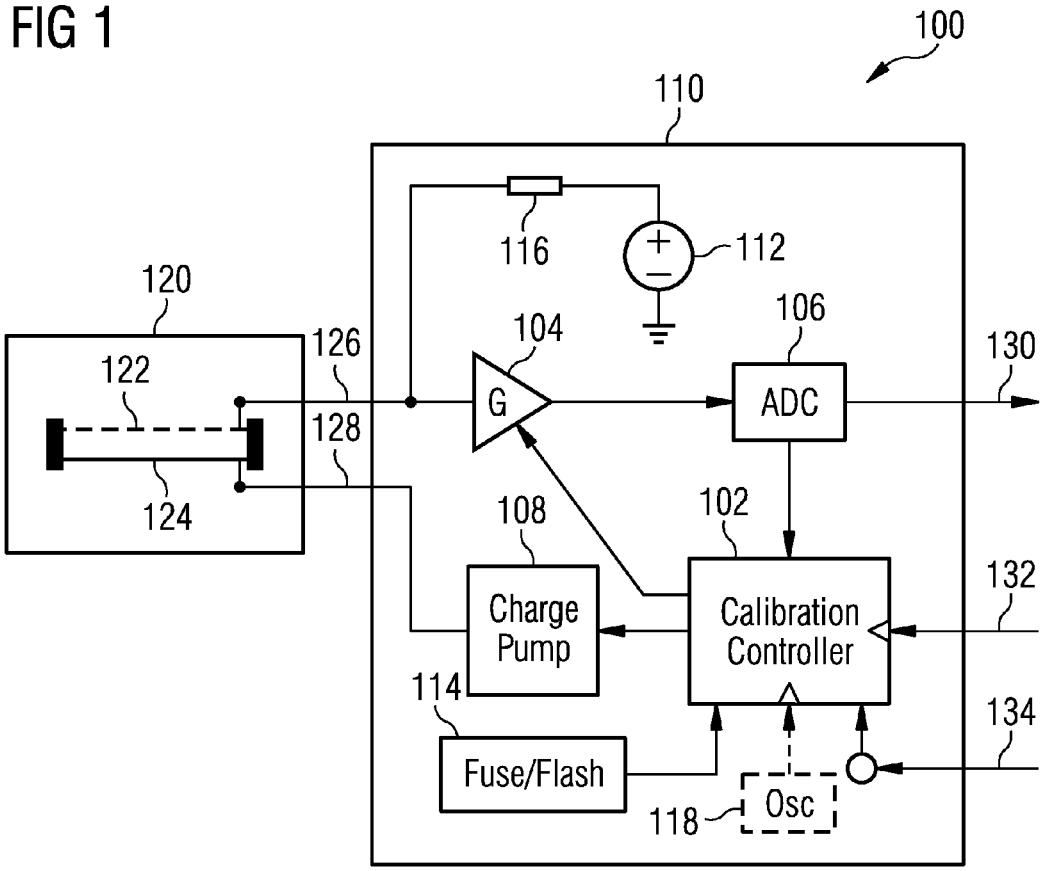
FIG. 1 illustrates a schematic of an embodiment transducer system.

FIG. 1 illustrates a schematic of an embodiment transducer system 100 having an interface circuit 110 coupled to a microphone 120 via terminals 126 and 128. The microphone is shown as a capacitive MEMS microphone 120 with a deflectable membrane 124 coupled to terminal 128 and a perforated rigid backplate 122 coupled to terminal 126. According to an embodiment, a sound wave from a sound port (not shown) incident on membrane 124 causes membrane 124 to deflect. The deflection changes the distance between membrane 124 and backplate 122 and changes the capacitance because backplate 122 and membrane 124 form a parallel plate capacitor. The change in capacitance is detected as a voltage change between terminals 126 and 128. Interface circuit 110 measures the voltage change between terminals 126 and 128 and provides an output signal at output 130 that corresponds to the sound wave incident on membrane 124.

According to an embodiment, the sensitivity of MEMS microphone 120 is affected by fabrication variations such that even MEMS microphones fabricated using a same process, on a same wafer, with a same design may have different sensitivity values. In various embodiments, the sensitivity of MEMS microphone 120 is dependent on a bias voltage applied across terminals 126 and 128. An overall sensitivity of the transducer system 100, including the sensitivity of MEMS microphone 120 and a sensitivity of interface circuit 110, may also be influenced by a gain G of amplifier 104, which may be coupled to terminal 126. Conventionally, a calibration procedure is applied to a MEMS microphone during manufacturing and an interface circuit is either programmed or selected from a limited number of variations to set the bias voltage and gain in order to set the sensitivity of the complete transducer system.

In an embodiment, interface circuit 110 includes a calibration controller 102 capable of setting a bias voltage supplied to MEMS microphone 120 via charge pump 108 and capable of setting a gain G of amplifier 104. In various embodiments, charge pump 108 is a variable voltage charge pump and amplifier 104 is a variable gain amplifier. In some embodiments, amplifier 104 may be implemented, for example, as described in U.S. patent application Ser. No. 13/665,117, filed on Oct. 31, 2012 and entitled "System and Method for Capacitive Signal Source Amplifier," which application is incorporated herein by reference in its entirety. Amplifier 104 may receive input signals from MEMS microphone 120 via terminal 126 which is coupled to backplate 122. Charge pump 108 may provide a variable bias voltage to MEMS microphone 120 via terminal 128 which is coupled to membrane 124. Charge pump 108 may be implemented, for example, as described in U.S. patent application Ser. No. 13/217,890, filed on Aug. 25, 2011 and entitled "System and Method for Low Distortion Capacitive Signal Source Amplifier," which application is incorporated herein by reference in its entirety. According to an alternative embodiment, backplate 122 may be coupled to terminal 128 and membrane 124 may be coupled to terminal 126.

According to the embodiment shown, interface circuit 110 includes a bias voltage source 112 coupled to terminal 126 via a resistive element 116. Amplifier 104 is coupled to a measurement circuit 106. In the embodiment shown, measurement circuit 106 is implemented as an analog to digital converter (ADC) 106 and is coupled to output 130 and calibration controller 102. As shown, calibration controller 102 receives a clock signal 132, detects a control signal 134, and is coupled to fuse 114. In various embodiments, fuse 114 may include a non-transitory memory that is set to prevent further calibration after an initial calibration. In some embodiments, fuse 114 may be implemented as a physical fuse, flash memory, or any other non-volatile physical memory.

According to various embodiments, calibration controller 102 detects a calibration procedure start condition, ramps the bias voltage of charge pump 108 until pull-in is detected, sets the bias voltage of charge pump 108 based on a detected pull-in voltage, measures an output signal from ADC 106, and adjusts the gain G of amplifier 104 if necessary. More detailed descriptions of embodiment calibration procedures are described below with reference to the remaining figures.

In some embodiments, calibration controller 102 may include a state machine with digital control logic. In other embodiments, calibration controller 102 may be implemented as a microcontroller. In further embodiments, calibration controller 102 may be implemented as an analog control circuit. Interface circuit 110 may be a fully custom or semi-custom integrated circuit (IC). In various embodiments, interface circuit 110 may be packaged separately or be included as part of a system, such as a system on a chip (SoC). In some embodiments, MEMS microphone and interface circuit 110 may be fabricated and diced on a same semiconductor die. Those skilled in the art will easily imagine numerous other implementations and configurations and such variations are within the scope of the embodiments described herein.

Figure 2:
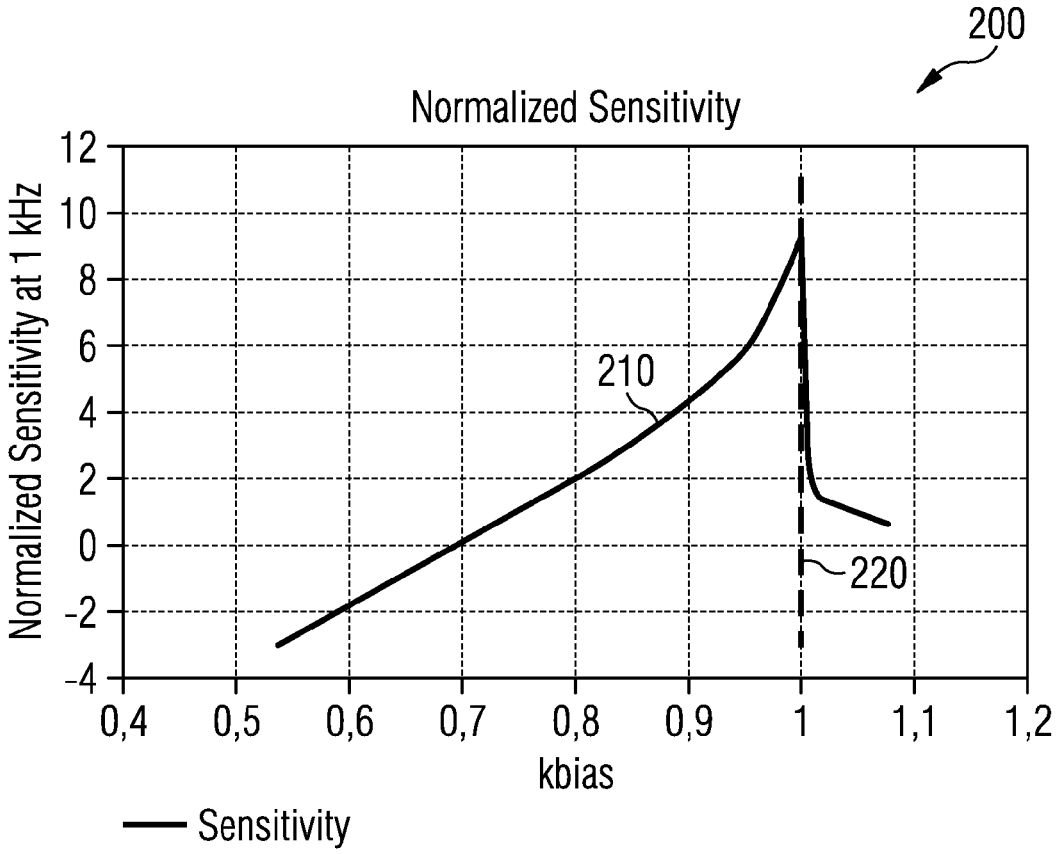
FIG. 2 illustrates a waveform diagram of an embodiment transducer sensitivity plot.

FIG. 2 illustrates a waveform diagram of an embodiment transducer sensitivity plot 200 that may be used during a calibration procedure in order to determine a pull-in voltage of a MEMS device, such as a MEMS microphone for example. According to the embodiment shown, sensitivity waveform 210 is depicted for an increasing bias voltage applied to a plate of the MEMS microphone. For example, sensitivity waveform 210 may indicate the bias voltage applied to membrane 124 of MEMS microphone 120 via a variable bias generator such as charge pump 108. In the embodiment shown, as the applied bias voltage increases, the sensitivity of the MEMS microphone increases. As shown, the sensitivity waveform 210 may continue to increase until pull-in occurs at pull-in voltage 220. For a MEMS microphone, pull-in is when the bias voltage reaches a point where the electrostatic forces between backplate and membrane are strong enough to cause the plates to pull together and physically touch. As shown by sensitivity waveform 210, the MEMS microphone sensitivity substantially decreases once a bias voltage greater than or equal to pull-in voltage 220 is applied to one of the plates.

According to various embodiments, features of sensitivity waveform 210 may be used in a test to determine pull-in voltage 220 for a MEMS microphone, such as MEMS microphone 120 for example. In some embodiments, a constant known input sound wave is provided to MEMS microphone 120 as the bias voltage applied to one of the plates of MEMS microphone 120 is increased by charge pump 108. According to various embodiments, calibration controller 102 monitors an electrical output signal from ADC 106 as the bias voltage is increased. The on-chip control block detects a drop in the electrical output signal level when pull-in occurs and may store the value of pull-in voltage 220. According to various embodiments, these steps may be performed partially or fully by interface circuit 110 with numerous embodiments as described herein.

Figure 3:
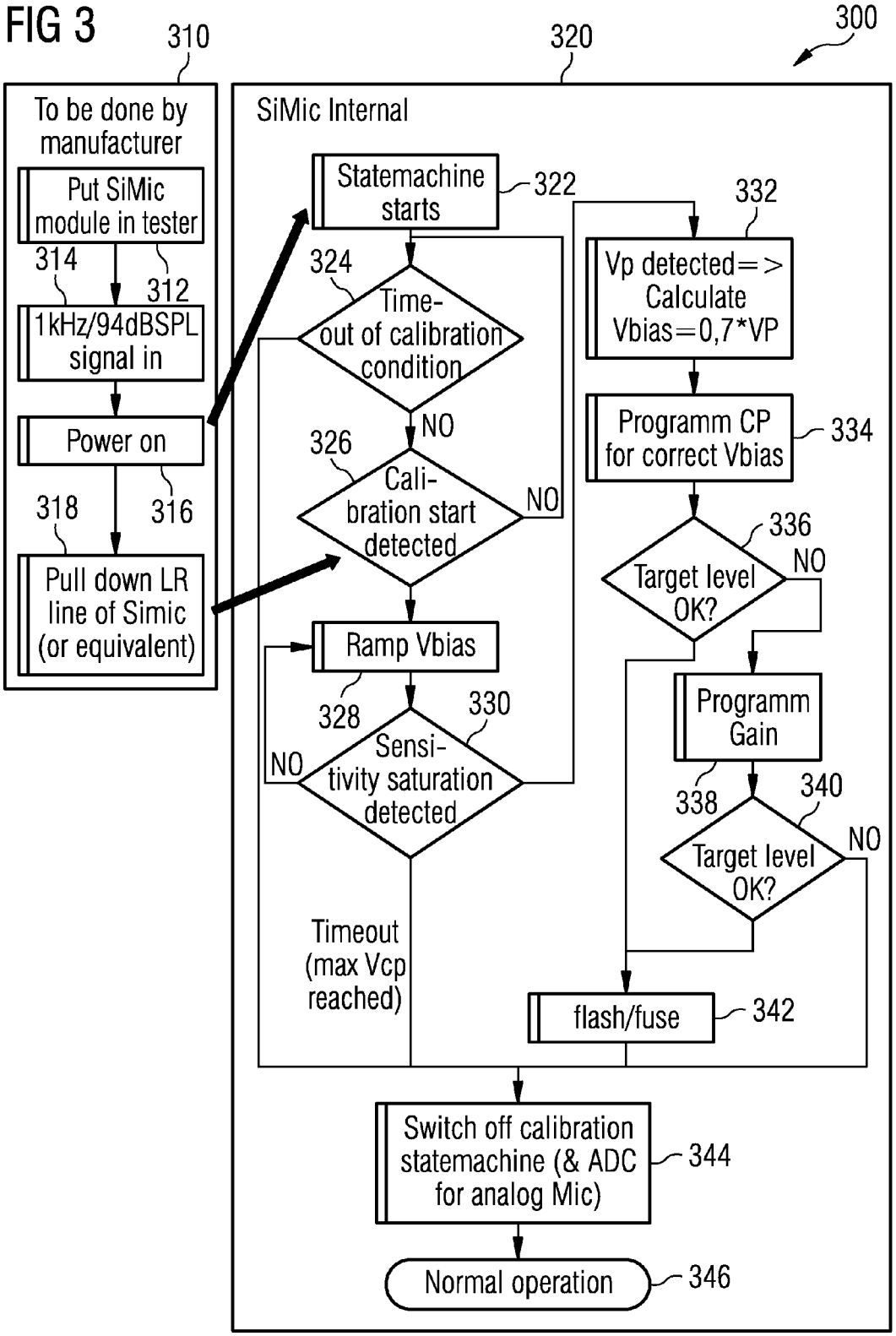
FIG. 3 illustrates a flowchart diagram of an embodiment calibration procedure.

FIG. 3 illustrates a flowchart diagram of an embodiment calibration procedure 300 that includes external procedure 310 and internal procedure 320, both of which may be performed during fabrication or packaging. Internal procedure 320 may be performed concurrently inside an interface circuit and may be performed in order to calibrate a MEMS device by setting a sensitivity, for example. According to an embodiment, external procedure 310 includes placing a MEMS device in a module tester in step 312, applying a test tone of a known amplitude and frequency in step 314, powering on the MEMS device and interface circuit in step 316, and setting a control signal for testing in step 318. The module tester in step 312 may include an acoustic test fixture or test unit configured to be coupled to a microphone and provide acoustic test signals. In various embodiments, the MEMS device may include MEMS microphone 120, the interface circuit may include interface circuit 110, and setting a control signal may include setting control signal 134.

In a specific embodiment, the test tone in step 314 may have a 1 kHz frequency and 94 dB sound pressure level (SPL), generally equivalent to about 1 Pascal. In some embodiments, setting the control signal in step 318 may include asserting the control signal for a certain period of time. In various embodiments, the control signal (such as control signal 134) may be active high or active low and may be a left-right (LR) indicator control input used during normal operation of a stereo system to indicate if the microphone signal is routed to a left or right speaker. In such embodiments, the LR input may be set low during start up for step 318 to indicate a calibration procedure is being performed.

According to various embodiments, setting the control signal in step 318 may also include setting an external clock signal to a special frequency and comparing to an internal oscillator. Some embodiments may include setting the LR input according to a predetermined pattern. Further embodiments may include pulling an output pin high or low externally. In some embodiments, the supply voltage applied to the interface circuit may be modified during a start condition. Setting the control signal may include applying a test tone. Additionally, any combination of such example control signals is also possible as a part of setting the control signal in step 318.

In some embodiments, when the MEMS device and interface circuit are powered on in step 316, a calibration state machine begins operation in step 322 of internal procedure 320. Internal procedure 320 then checks for a calibration timeout in step 324. If the calibration has not timed out, a calibration start condition is checked in step 326. In some embodiments, a start condition may include a control signal (such as control signal 134) being set to a specific value and/or a specific tone being supplied to the MEMS device. In a specific embodiment, a LR-input is set low and a 1 kHz and 94 dB SPL signal is detected by a MEMS microphone during a start condition. According to various embodiments, a calibration memory bit or a fuse bit, as indicated by fuse 114 in FIG. 1, is checked during step 326. In some embodiments, if the fuse bit indicates that calibration has already taken place, a calibration start condition is not detected regardless of other control signals.

According to various embodiments, if a start condition is detected in step 326, a bias voltage is increased or ramped in step 328 and a sensitivity drop is checked for in step 330 as described with reference to FIG. 2. If no calibration start condition is detected, steps 324 and 326 are continually repeated until timeout or a start condition is detected. In some embodiments, once the bias voltage begins ramping, steps 328 and 330 are continually repeated until pull-in is detected by the sensitivity drop in step 330 or a maximum bias voltage is applied.

According to the embodiment shown, if pull-in is detected, a determined pull-in voltage is used to calculate a fixed bias voltage in step 332 to apply to the MEMS device in step 334 (such as setting charge pump 108 to apply a fixed bias voltage to membrane 124). The sensitivity of the MEMS device and interface circuit may be tested and compared to a target sensitivity range in step 336. In some embodiments, if the sensitivity is not within the target sensitivity range, an amplifier gain is adjusted in step 338 and the sensitivity is may be tested and compared to the target sensitivity range a second time in step 340. According to various embodiments, if the sensitivity is within the target sensitivity range in either step 336 or step 340, a sealing step 342 may be performed which prevents any calibration procedure from being performed thereafter. Step 342 may include setting a fuse that may be coupled to the calibration state machine. In other embodiments, step 342 may include setting a value in a non-transitory memory such as flash memory.

According to various embodiments, the final steps of internal procedure 320 include switching off the calibration state machine in step 342 and entering normal MEMS device and interface circuit operation in step 344. In some embodiments, the calibration state machine may be calibration controller 102 or may be included in calibration controller 102. In an alternative embodiment where interface circuit 110 provides an analog output 130, step 344 may also shut off power to a measurement circuit (such as an ADC in some embodiments) coupled to the calibration state machine. The steps described as a part of calibration procedure 300 may be performed in various different orders and may be modified to include additional steps or fewer steps. Various combinations, orders, and modifications are within the scope of the embodiments described herein.

Figure 4:
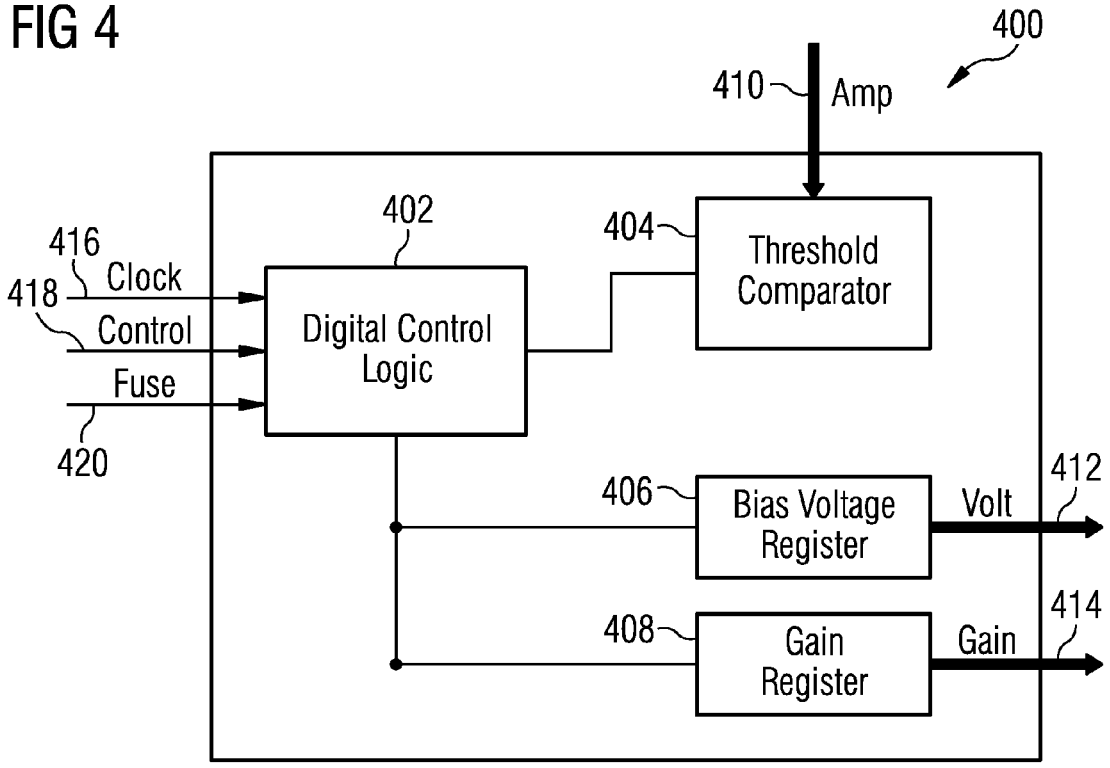
FIG. 4 illustrates a block diagram of an embodiment calibration controller.

FIG. 4 illustrates a block diagram of an embodiment calibration controller 400 including digital control logic 402, threshold comparator 404, bias voltage register 406, and gain register 408. According to various embodiments, calibration controller 400 performs a calibration procedure (such as calibration procedure 300) for a MEMS device (such as MEMS microphone 120) and may be an implementation of calibration controller 102.

According to various embodiments, digital control logic 402 may contain a state machine having state registers, next state logic, and output logic. Digital control logic 402 may be implemented as a synchronous state machine clocked by clock signal 416. In various embodiments, digital control logic receives a control signal 418 which may correspond to start condition detection. In a specific embodiment, control signal 418 may be a left-right control signal for a microphone system. Digital control logic 402 also receives a calibration bit 420 that may originate from a calibration memory bit or a fuse bit, such as fuse 114 in FIG. 1, for example. In some embodiments, calibration bit 420 indicates of a calibration procedure has been performed and may prevent further calibration procedures.

In the embodiment shown, digital control logic 402 is coupled to threshold comparator 404 which provides information related to an output level of a MEMS device to digital control block 402. Threshold comparator 404 receives information about the output level from amplitude input 410. In an embodiment, amplitude input 410 may come from a measurement circuit such as ADC 106 in FIG. 1. In various embodiments, threshold comparator 404 may provide a comparison result to digital control logic 402 indicating that the output level is within a target range. Threshold comparator 402 may have a fixed target range or a programmable target range.

According to the embodiment shown, digital control logic 402 is coupled to bias voltage register 406 and gain register 408 and may be configured to perform calibration procedure 300 by implementing the calibration state machine. In various embodiments, digital control logic 402 may be configured to determine a sensitivity and pull-in voltage of a MEMS device (such as MEMS microphone 120) based on information provided by threshold comparator 404 and set a bias voltage value and/or a gain value with bias voltage register 406 and gain register 408, respectively. The set bias voltage value and gain value may be provided to a variable voltage bias generator and a variable gain amplifier via outputs 412 and 414, respectively.

In a specific example, bias voltage register 406 provides a bias voltage value to charge pump 108 in FIG. 1 via output 412 and gain register 408 provides a gain value to amplifier 104 in FIG. 1 via output 414. The specific values supplied by bias voltage register 406 and gain register 408 are selected by digital control logic 402 based on a calibration procedure, such as calibration procedure 300. According to various embodiments, the calibration state machine according to procedure 300 may be implemented in digital control logic 402 using various techniques and components known to those skilled in the art. For example, the calibration state machine may include registers, next state logic, and output logic; it may be implemented as a Mealy or a Moore machine; and/or it may include various functional analog or digital blocks for specific comparisons, calculations, or other steps.

Figure 5A:
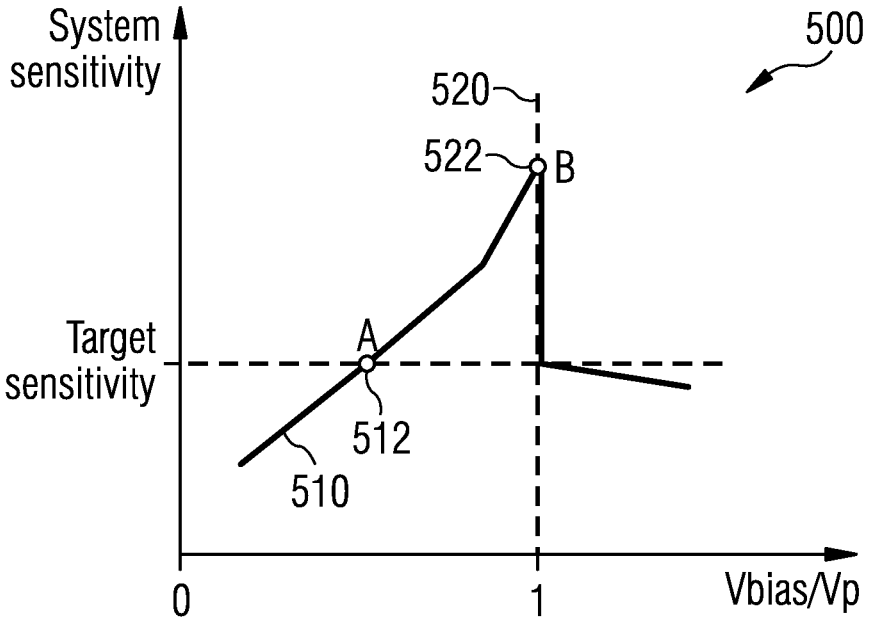
FIGS. 5*a*-5*b* illustrate waveform diagrams of an embodiment calibration method.
Figure 5B:
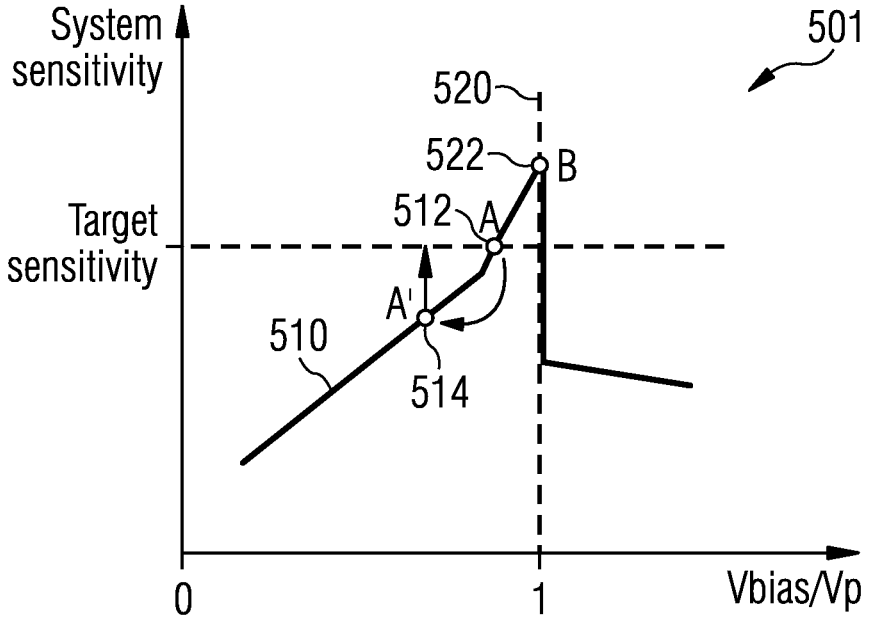

FIGS. 5*a*-5*b* illustrate waveform diagrams of an embodiment calibration method including calibration step 500 and calibration step 501 for setting a bias voltage for a MEMS device. In specific embodiments, calibration steps 500 and 501 may be applied to set the bias voltage supplied by charge pump 108 to membrane 124 of MEMS microphone 120 in FIG. 1. FIGS. 5*a* and 5*b* illustrate a sensitivity waveform 510 for a MEMS microphone as an applied bias voltage is increased. In various embodiments, calibration steps 500 and 501 may correspond to steps 328-338 in FIG. 3 and may be performed in order to set the bias voltage (such as in step 334) and amplifier gain (such as in step 338) during a calibration procedure. FIG. 5*a* depicts target sensitivity 512 with a bias voltage well away from pull-in voltage 520 and peak sensitivity 522. In such an embodiment, a bias voltage may be selected for the MEMS microphone to set the sensitivity within a range around target sensitivity 512.

FIG. 5*b* depicts target sensitivity 512 with a bias voltage closer to pull-in voltage 520. In such an embodiment, the bias voltage may be adjusted to be further from pull-in voltage 520. Setting the bias voltage lower causes the MEMS microphone to have lower sensitivity 514. In a specific embodiment, the bias voltage is set to be no greater than 70% of pull-in voltage 520. In other embodiments, the bias voltage may be set to any percentage of the pull-in voltage 520. In some embodiments, when the set bias voltage produces lower sensitivity 514, amplifier gain may be increased in order to increase system sensitivity up to the level of target sensitivity 512 without increasing the bias voltage. In a specific example, amplifier gain G for amplifier 104 may be set by an output of calibration controller 102 or calibration controller 400.

Figure 6:
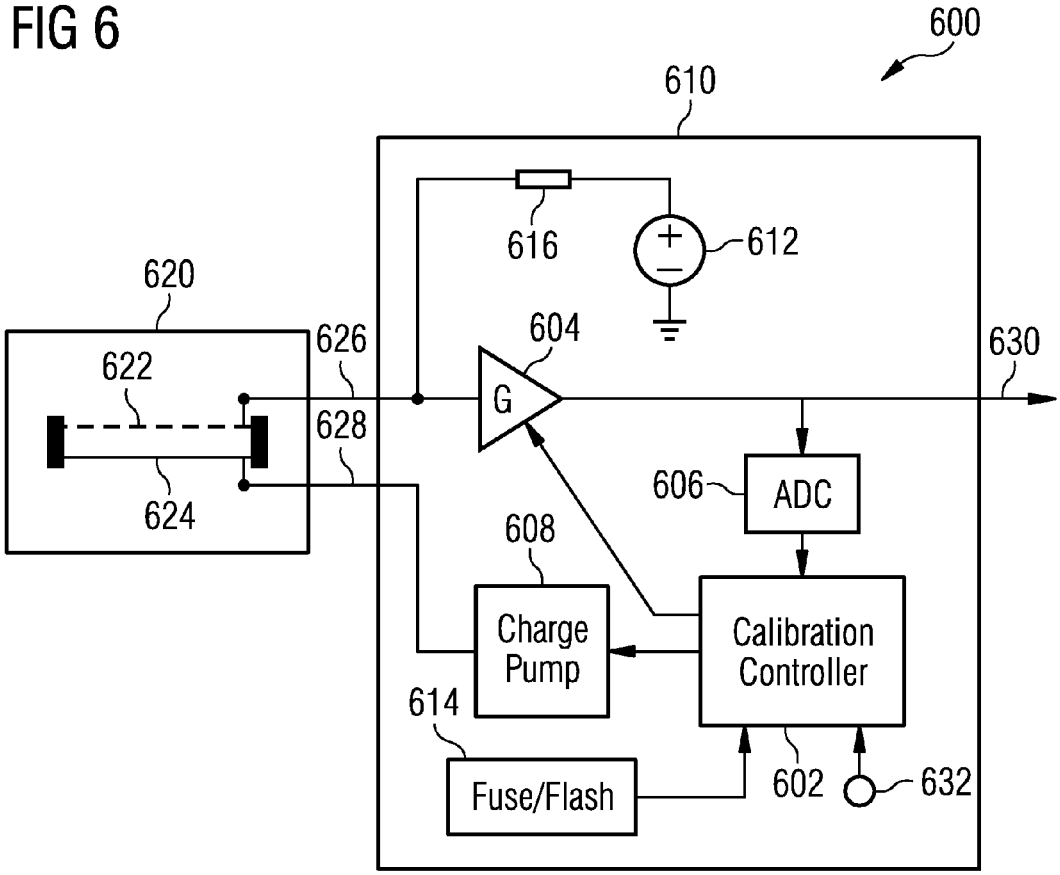
FIG. 6 illustrates a schematic of another embodiment transducer system.

FIG. 6 illustrates a schematic of another embodiment transducer system 600 including a MEMS microphone 620 and an interface circuit 610 that provides an analog output 630. Because output 630 is an analog output, ADC 606 is not placed between amplifier 604 and output 630. ADC 606 may include any type of measurement circuit and provides output signal information to calibration controller 602 during a calibration procedure. In various embodiments, ADC 606 may be disabled or powered off during normal operation after calibration. In some embodiments, ADC 606 may be implemented as a slower or simpler ADC than ADC 106 in FIG. 1. For example, ADC 106 in FIG. 1 may be implemented using a high order sigma-delta ADC with post-filtering in order to provide high quality audio performance (e.g. having high dynamic range). In some embodiments, because ADC 606 does not provide an output digital signal, ADC 606 may only provide amplitude information and may be implemented with a simple, low power, successive approximation ADC. In another embodiment, ADC 606 may be an analog amplitude detection circuit with a digitized output. The other components depicted in FIG. 6 may have similar function to those described with reference to FIG. 1.

Figure 7:
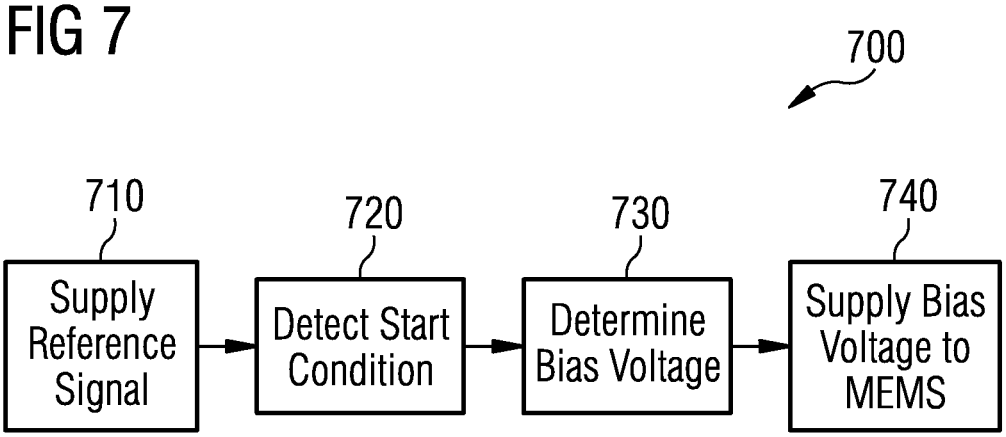
FIG. 7 illustrates a block diagram of an embodiment calibration method.

FIG. 7 illustrates a block diagram of an embodiment calibration method 700 that includes steps 710, 720, 730, and 740 for calibrating a MEMS device and interface circuit. Step 710 includes applying a known reference signal for calibration to the MEMS device. In some embodiments, the MEMS device is a MEMS microphone and the reference signal may be a 1 kHz and 94 dB SPL tone. Other frequencies and pressure levels may also be used.

According to various embodiments, steps 720, 730, and 740 may be performed by the interface circuit and, specifically, by a calibration state machine within the interface circuit. Step 720 includes detecting a start condition. In various embodiments, the start condition may include checking a write protect memory, checking a timeout after reset, checking a control signal, and/or detecting a specific tone (e.g. a 1 kHz tone). The control signals and start condition may include any of the elements described with reference to the preceding figures. In particular, the embodiments described with reference to steps 318 and 326 in FIG. 3 may be included in the start condition of step 720. Step 730 includes determining a bias voltage to apply to the MEMS device in order to set a specific sensitivity. Determining the bias voltage may include determining the pull-in voltage and selecting a bias voltage that is some percentage of the pull-in voltage. In a specific embodiment, the bias voltage is selected as 70% of the pull-in voltage. Step 740 includes applying the determined bias voltage to the MEMS device. In various embodiments, supplying the bias voltage to the MEMS device may include setting the value of a bias generator coupled to a MEMS microphone with a value from a memory. Additional embodiments may include setting an amplifier gain and measuring sensitivity of the MEMS device and interface circuit together (not shown).

According to various embodiments, an interface circuit includes a variable voltage bias generator configured to be coupled to a transducer, a measurement circuit configured to be coupled to an output of the transducer, and a calibration controller coupled to the bias generator and the measurement circuit. The measurement circuit is configured to measure an output amplitude of the transducer, and the calibration controller is configured to set a sensitivity of the transducer and interface circuit during an auto-calibration sequence.

In some embodiments, the interface circuit includes the transducer. The calibration controller may be configured to detect a calibration sequence start condition, determine a pull-in voltage of the transducer, determine a fixed bias voltage based on the pull-in voltage, and supply the fixed bias voltage to the transducer. The interface circuit may also include an amplifier configured to be coupled to the transducer, the calibration controller, and the measurement circuit. In some embodiments, the measurement circuit includes an analog to digital converter (ADC). The calibration controller may also be configured to determine a sensitivity of the transducer and interface circuit, and adjust the amplifier gain if the sensitivity is not within a target sensitivity range.

In some embodiments, the transducer includes a first capacitive plate coupled to the amplifier and a second capacitive plate coupled to the bias generator. The interface circuit may also include a bias voltage source coupled to the first capacitive plate and the amplifier. According to various embodiments, the bias generator, the measurement circuit, and the calibration controller are all deposed on a same integrated circuit. The calibration controller may include digital control logic coupled to the bias generator. The calibration controller may further include a bias voltage memory coupled to the digital control logic and a threshold comparator coupled to the digital control logic and the measurement circuit. The interface circuit may also include a write protect fuse that is configured to disable the auto-calibration sequence after a first auto-calibration sequence is performed.

According to various embodiments, a method of calibrating a transducer includes supplying a reference input signal for calibration to the transducer and performing an auto-calibration procedure. The auto-calibration procedure may include detecting a calibration procedure start condition, determining a fixed bias voltage, and supplying the fixed bias voltage to the transducer. The method may also include attaching an auto-calibrating interface circuit to the transducer. In some embodiments, determining a fixed bias voltage includes determining a pull-in voltage of the transducer and calculating a fixed bias voltage based on the pull-in voltage.

According to further embodiments, the method may also include determining a sensitivity of the transducer a first time and adjusting an amplifier gain if the sensitivity is not within a target sensitivity range. The method may include determining the sensitivity of the transducer a second time and preventing further calibration when the sensitivity calculated the second time is within a target sensitivity range. The method may include indicating a failed calibration when the sensitivity calculated the second time is not within a target sensitivity range.

In some embodiments, detecting a calibration procedure start condition includes checking a calibration memory bit and detecting a first control signal value. Detecting a calibration procedure start condition may also include checking a calibration memory bit and detecting the reference input signal. The reference input signal may include a tone with a first frequency and a first sound pressure level.

In various embodiments, the method includes alternatingly increasing a bias voltage supplied to the transducer and measuring an output signal produced by supplying the reference input signal, detecting a first threshold at which the measured output signal decreases, and calculating a fixed bias voltage based on the first threshold. The method may also include determining a sensitivity of the transducer a first time, adjusting an amplifier gain if the sensitivity is not within a target sensitivity range, determining the sensitivity of the transducer a second time, preventing further calibration if the sensitivity calculated the second time is within a target sensitivity range, and indicating a failed calibration if the sensitivity calculated the second time is not within a target sensitivity range.

According to various embodiments, a transducer system includes a MEMS microphone having a backplate with a first terminal and a membrane with a second terminal and an auto-calibrating interface circuit. The auto-calibrating interface circuit may include an analog to digital converter (ADC), a bias generator coupled to the second terminal, and a calibration state machine coupled to the bias generator. The bias generator may be configured to perform an auto-calibration procedure that includes determining a pull-in voltage of the MEMS microphone, and setting the bias generator based on the determined pull-in voltage. In some embodiments, the ADC, the bias generator, and the calibration state machine are deposed on a same integrated circuit.

The transducer system may also include an amplifier coupled to the first terminal and the ADC. In some embodiments, the calibration state machine is coupled to the amplifier and may be configured to compare a sensitivity of the transducer and interface circuit to a target sensitivity range and change the amplifier gain if the sensitivity of the transducer and interface circuit is outside the target sensitivity range. The calibration state machine may include digital control logic coupled to the bias generator, a bias voltage memory coupled to the digital control logic, and a threshold comparator coupled to the digital control logic and the ADC. The calibration state machine may also include an amplifier gain memory coupled to the digital control logic, and the digital control logic may be coupled to the amplifier. In various embodiments, the MEMS microphone and the auto-calibrating interface circuit are deposed on a same integrated circuit.

Advantages of some embodiments include the ability to calibrate the signal path of an audio system without using external measurement and/or calibration equipment. In particular, an external interface controller, an external control switch, and external interface circuitry implemented on the interface chip is not necessary to perform a calibration in some embodiments. A further advantage in some embodiments is a short test time due to a large portion of the calibration process occurring without excessive interface bus traffic caused by an external tester.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. An interface circuit comprising:

a variable voltage bias generator configured to be coupled to a transducer;

a measurement circuit configured to be coupled to an output of the transducer, the measurement circuit configured to measure an output amplitude of the transducer; and a calibration controller coupled to the bias generator and the measurement circuit, wherein the calibration controller is configured to set a sensitivity of the transducer and interface circuit during an auto-calibration sequence.

2. The interface circuit of claim 1, further comprising the transducer.

3. The interface circuit of claim 2, wherein the calibration controller is further configured to:

detect a calibration sequence start condition;

determine a pull-in voltage of the transducer;

determine a fixed bias voltage based on the pull-in voltage; and supply the fixed bias voltage to the transducer.

4. The interface circuit of claim 3, further comprising an amplifier configured to be coupled to the transducer, the calibration controller, and the measurement circuit, the amplifier having an amplifier gain.

5. The interface circuit of claim 4, wherein the measurement circuit comprises an analog to digital converter (ADC).

6. The interface circuit of claim 4, wherein the calibration controller is further configured to:

determine a sensitivity of the transducer and interface circuit; and adjust the amplifier gain if the sensitivity is not within a target sensitivity range.

7. The interface circuit of claim 4, wherein the transducer comprises a first capacitive plate coupled to the amplifier and a second capacitive plate coupled to the bias generator.

8. The interface circuit of claim 7, further comprising a bias voltage source coupled to the first capacitive plate and the amplifier.

9. The interface circuit of claim 1, wherein the bias generator, the measurement circuit, and the calibration controller are all deposed on a same integrated circuit.

10. The interface circuit of claim 1, wherein the calibration controller comprises digital control logic coupled to the bias generator.

11. The interface circuit of claim 10, wherein the calibration controller further comprises:

a bias voltage memory coupled to the digital control logic; and a threshold comparator coupled to the digital control logic and the measurement circuit.

12. The interface circuit of claim 1, further comprising a write protect fuse, wherein the write protect fuse is configured to disable the auto-calibration sequence after a first auto-calibration sequence is performed.

13. A method of calibrating a transducer comprising:

supplying a reference input signal for calibration to the transducer; and performing an auto-calibration procedure, comprising:

detecting a calibration procedure start condition;

determining a fixed bias voltage; and supplying the fixed bias voltage to the transducer;

and the method further comprising:

determining a sensitivity of the transducer a first time; and adjusting an amplifier gain if the sensitivity is not within a target sensitivity range.

14. The method of claim 13, further comprising coupling an auto-calibrating interface circuit to the transducer.

15. The method of claim 13, wherein determining a fixed bias voltage comprises:

determining a pull-in voltage of the transducer; and calculating a fixed bias voltage based on the pull-in voltage.

16. The method of claim 13, further comprising:

determining the sensitivity of the transducer a second time; and preventing further calibration when the sensitivity calculated the second time is within a target sensitivity range.

17. The method of claim 16, further comprising indicating a failed calibration when the sensitivity calculated the second time is not within a target sensitivity range.

18. The method of claim 13, wherein detecting a calibration procedure start condition comprises checking a calibration memory bit and detecting a first control signal value.

19. The method of claim 13, wherein detecting a calibration procedure start condition comprises checking a calibration memory bit and detecting the reference input signal.

20. The method of claim 19, wherein the reference input signal comprises a tone with a first frequency and a first sound pressure level.

21. The method of claim 13, wherein the method further comprises:

alternatingly increasing a bias voltage supplied to the transducer and measuring an output signal produced by supplying the reference input signal;

detecting a first threshold at which the measured output signal decreases; calculating a fixed bias voltage based on the first threshold; determining the sensitivity of the transducer a second time;

preventing further calibration if the sensitivity calculated the second time is within a target sensitivity range; and indicating a failed calibration if the sensitivity calculated the second time is not within a target sensitivity range.

22. A transducer system comprising:

a microelectromechanical system (MEMS) microphone having a backplate with a first terminal and a membrane with a second terminal; and an auto-calibrating interface circuit comprising:

an analog to digital converter (ADC);

a bias generator coupled to the second terminal; and a calibration state machine coupled to the bias generator and configured to perform an auto-calibration procedure, comprising:

determining a pull-in voltage of the MEMS microphone, and setting the bias generator based on the determined pull-in voltage;

wherein the ADC, the bias generator, and the calibration state machine are deposed on a same integrated circuit.

23. The transducer system of claim 22, further comprising an amplifier coupled to the first terminal and the ADC, the amplifier having an amplifier gain.

24. The transducer system of claim 23, wherein the calibration state machine is coupled to the amplifier and is further configured to:

compare a sensitivity of the MEMS microphone and interface circuit to a target sensitivity range, and change the amplifier gain if the sensitivity of the MEMS microphone and interface circuit is outside the target sensitivity range.

25. The transducer system of claim 23, wherein the calibration state machine comprises:

digital control logic coupled to the bias generator;

a bias voltage memory coupled to the digital control logic; and a threshold comparator coupled to the digital control logic and the ADC.

26. The transducer system of claim 25, wherein the calibration state machine further comprises an amplifier gain memory coupled to the digital control logic, and wherein the digital control logic is coupled to the amplifier.

27. The transducer system of claim 22, wherein the MEMS microphone and the auto-calibrating interface circuit are deposed on a same integrated circuit.

* * * * *